US005405134A

United States Patent [19]

Wolfram

[11] Patent Number: 5,405,134

[45] Date of Patent: Apr. 11, 1995

[54] GAS EJECTING HANDLE ATTACHMENT FOR BATONS AND FLASHLIGHTS

[76] Inventor: Robert D. Wolfram, P.O. Box 11145, Kansas City, Kans. 66111

[21] Appl. No.: 91,962

[22] Filed: Jul. 15, 1993

[51] Int. Cl.[6] ..... A63B 15/02; F41B 15/02

[52] U.S. Cl. ..... 273/84 R; 362/102

[58] Field of Search ..... 273/84 R, 84 ES; 252/350; 239/525, 526; 362/102

[56] References Cited

U.S. PATENT DOCUMENTS

| | | | |
|---|---|---|---|
| 5,086,377 | 2/1992 | Roberts | 273/84 R |
| 5,108,098 | 4/1992 | Ashihara | 273/84 R |
| 5,242,349 | 9/1993 | Reiff et al. | 273/84 R |

OTHER PUBLICATIONS

1991 Gall's Inc. catalog, p. 134.

*Primary Examiner*—Vincent Millin
*Assistant Examiner*—William M. Pierce
*Attorney, Agent, or Firm*—Chase & Yakimo

[57] ABSTRACT

A security device comprises a handle extending from an adjustable collar with the latter designed to contiguously encircle a club, flashlight or other security baton-type device. A chemical canister is releasably embedded within the handle with the latter presenting a seat for the user's thumb. The user, upon grasping the handle, positions the thumb in the seat and adjacent the activating mechanism of the canister. The device allows for transport and/or use of a club-like object and chemical canister embedded therein.

22 Claims, 2 Drawing Sheets

GAS EJECTING HANDLE ATTACHMENT FOR BATONS AND FLASHLIGHTS

BACKGROUND OF THE INVENTION

The present invention pertains to a security device, and more particularly, to a handle for facilitating the concurrent use of a flashlight/club and/or a chemical retardant such as a mace canister or the like.

The uses of flashlights, clubs, nightsticks and chemical retardants for security purposes are well known. Security officials such as policeman, security guards, watchmen and the like are normally equipped with one or more of such devices in order to be able to fully perform the multitude of tasks which may arise during their security job duties. Heretofore such devices were independent of each other which required the security official to have to awkwardly transport the separate devices on a belt or the like. This decreased the effectiveness of access and use of the devices which created a dangerous situation to the user. For example if the official was holding the weapon in one hand, it would be impossible for him to access both a flashlight and the chemical retardant in the other. Thus it is desirable to have a device which can provide for the concurrent access and use of a flashlight/club and/or chemical retardant.

In response thereto I have invented a security device in the form of a handle which comprises an elongated grip extending from an adjustable collar. The collar receives a flashlight, security baton or club therein and is adjustable so as to contiguously surround the same. The grip has a bore therein for releasably receiving a chemical retardant canister containing mace, hot pepper or the like. The grip presents a port for discharge of the chemical therefrom as activated by the user's thumb seated at the top of the grip and adjacent the container's activating lever. Across the top of the grip is a cap for covering the canister during transport. The handle positions the flashlight and chemical mace so as to enable the user to allow concurrent access and/or use of the same. It is understood that an elongated flashlight could also be used as a club. Also, a club may be used in lieu of the flashlight if no illumination is desired.

It is therefore a general object of this invention to provide a security device for simultaneously transporting and using a club and chemical retardant device.

Another object of this invention is to provide a dual function security device, as aforesaid, such functions being readily available for concurrent or separate use.

Still a further object of this invention is to provide a security device, as aforesaid, which releasably receives a flashlight/club of various sizes and/or a chemical retardant canister therein.

A more particular object of this invention is to provide a device, as aforesaid, which positions the flashlight/club, the chemical retardant canister and the user's fingers in user-ready positions.

A particular object of this invention is to provide an effective clamping device for maintaining the flashlight/club in place during transport and use.

Other objects and advantages of this invention will be readily apparent as set forth from the accompanying specification, drawings and claims.

DESCRIPTION OF THE PREFERRED EMBODIMENT

Figure 1:
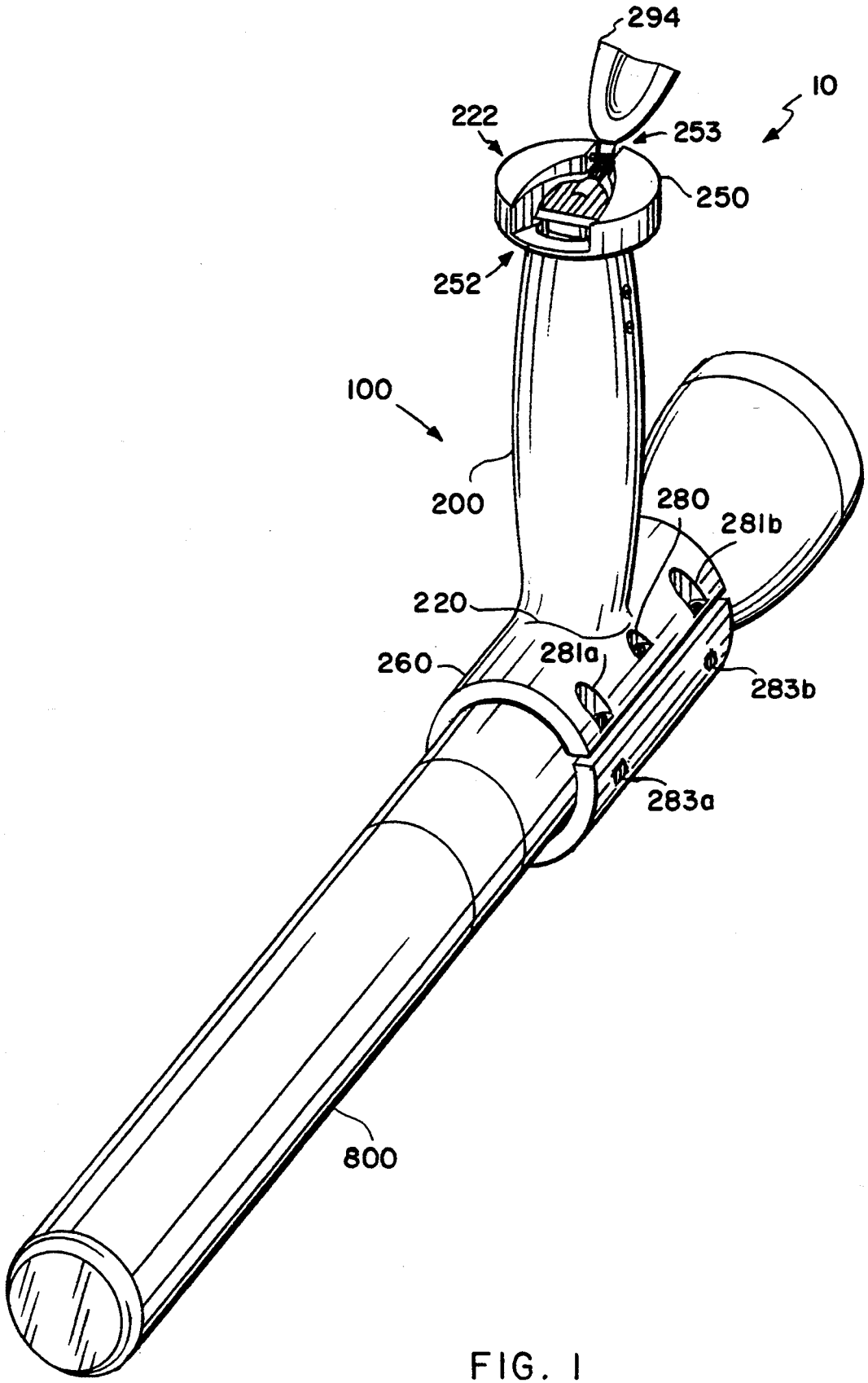
FIG. 1 is a perspective view of the security device utilizing a flashlight and tear gas canister with the handle cap being in an open position to allow functional access to the canister.
Figure 2:
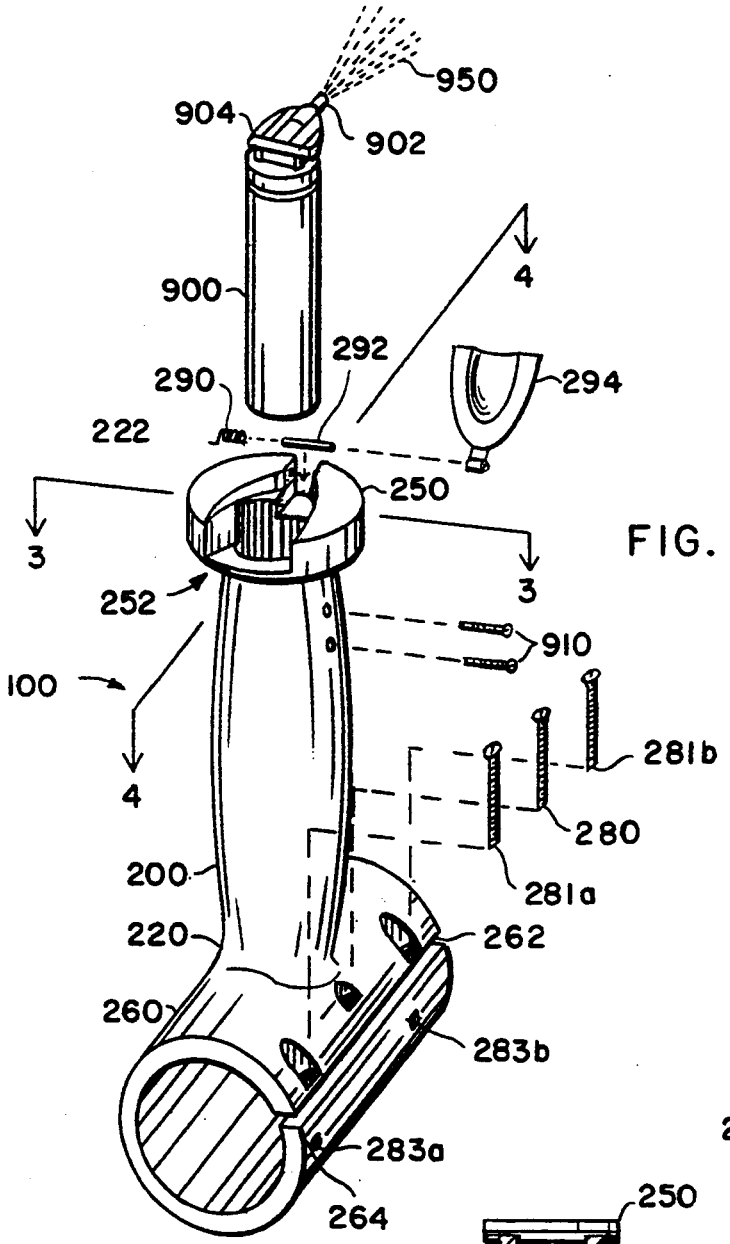
FIG. 2 is an exploded view of the handle assembly of the security device and the tear gas canister utilized therein.
Figure 3:
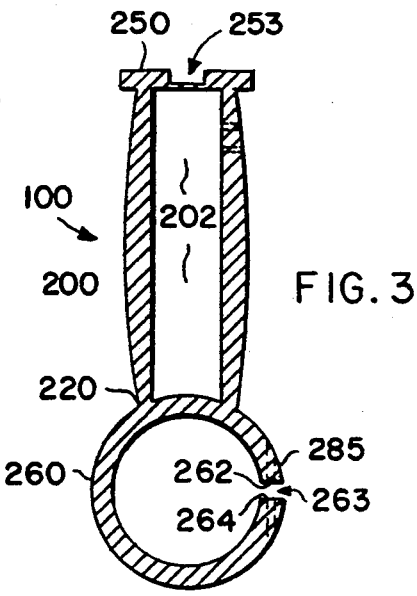
FIG. 3 is a section view taken along line 3—3 in FIG. 2.
Figure 4:
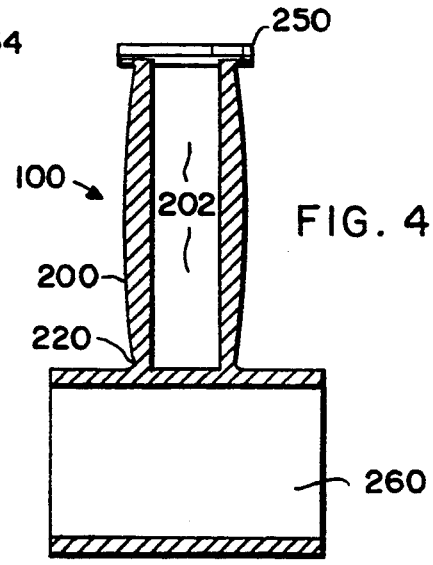
FIG. 4 is a section view of the device taken along line 4—4 in FIG. 2.

Turning more particularly to the drawings, FIG. 1 shows a security device 10 as comprising a handle assembly 100 with an associated flashlight 800 and mace canister 900. A nightstick, security baton or other club-like object may be used instead of the flashlight 800 if no illuminating function is desired. The mace canister 900 is a commercially available unit designed to discharge mace from nozzle 902 upon depression of the activating mechanism/lever 904. One such known assembly is the M602 personal size mace available from security supply dealers. Other similar security canisters may also be used utilizing mace, hot pepper or other available chemical retardant.

The handle assembly 100 generally comprises a grip 200 extending from an open collar 260 longitudinally extending from the closed or lower end 220 of the handle 200. The longitudinal collar 260 has a pair of facing, longitudinally extending free edges 262, 264. These spaced apart edges 262, 264 present an intermediate slot 263 with adjustable screws 280, 281.

The collar 260 material and design are such that the edges 262, 264 normally move one towards the other so as to close the slot 263. This action urges the collar 260 in a clamping relationship around the flashlight 800. A pair of screws 281*a*, 281*b* extend through collar bores 283*a*, 283*b*. A medial set screw 280 extends through bore 285 with the screw 280 end bearing against the inside surface of collar 260. Tightening of set screw 280 will cause the slot 263 to increase in width and thus the overall circumference of the collar 260. This action allows for insertion of the flashlight 800 therein. An opposed rotation or loosening of screw 280 will diminish the bearing action of screw 280 and thus allow the edges 262, 264 of collar 260 to normally move one towards the other. The screws 281*a*, 281*b*, having a non-threaded portion thereof at the top end thereof, restrict the amount of displacement between the edges 262, 264 during tightening of the medial screw 280. Thus, I have found that this screw combination is effective in first positioning and then securing the flashlight within collar 260.

Accordingly, the effective circumference of the collar 260 may be increased or decreased by rotation of screw 280 which increases or decreases the width of slot 263. This structure allows the collar 260 to contiguously encompass the flashlight 800, club or other security baton to be utilized therein.

Upwardly extending from the collar 260 is the grip 200. The upwardly extending grip 200 includes a central bore 202 for releasably receiving the chemical canister 900 therein. Screws 910 extend through the grip 200 and bear against the embedded canister 900 to hold the same within bore 202.

At the free end 222 of grip 200 is a knob 250. The knob 250 includes a rearwardly positioned notch 252 configured to present a seat for the thumb of the user. At the front end of the knob 250 is a smaller port 253 which is aligned with the nozzle 902 of canister 900 for discharge of retardant 950 therethrough. A spring 290 is wrapped about pin 292 which extends across this nozzle port 253. Pivotally attached about the pin 290 is a cap 294 for overlying the canister 900 when embedded within the grip 200. Cap 294 is biased by the spring 290 biased pin 292 into a normally closed position atop canister 900.

In use the screw 280 is tightened to allow for collar 260 expansion and insertion of the rear end of flashlight 800, club or other security baton through collar 260. Upon loosening screw 280 and then selectably tightening screws 281*a*, 281*b* the flashlight 800 is clamped within collar 260 as shown in FIG. 1. The on/off switch (not shown) of flashlight 800 can be adjacent the rear end 262 or forward end of collar 260 to allow for easy user access depending on the type of flashlight. The user's fingers are encircled about the grip 220 with either hand such that the index finger is adjacent the knob 250. Concurrently the user's thumb may be inserted underneath the cap 294 and into the seat 252 so as to lie adjacent or rest upon the canister 900 lever 904. Upon depression of lever 904, the retardant 950 is discharged from port 253.

Thus, the above structure 100 enables the user to simultaneously transport and operate the flashlight 800 or club and canister 900 with one hand. Accordingly, the other hand of the user is free for use of a firearm or other devices.

It is again herein noted that a club, nightstick or other baton may be used in lieu of the flashlight which also has a club-like function depending on the manner of use. Thus, I refer to such devices as clubs in the subsequent claims.

It is to be understood that while a certain form of this invention has been illustrated and described, it is not limited thereto except insofar as such limitations are included in the following claims and allowable functional equivalents thereof.

Having thus described the invention what is claimed as new and desired to be secured by letters patent is as follows:

1. A device for facilitating the use of a club with a chemical canister comprising:

collar means for clamping about a club;

means for adjusting a circumference of said collar means whereby to contiguously encircle a club;

a handle normally extending from said collar means for grasping by a user;

a bore in said handle configured to present means for receiving and embedding a canister in said handle;

means extending through said handle means for releasably engaging and securing a chemical canister in said bore; and means for discharge of a chemical from a canister embedded in said handle, whereupon to simultaneously transport and/or use an associated club and canister.

2. The device in claim 1 wherein said collar means comprises a band for encircling a club, said band presenting first and second spaced-apart facing edges, said adjusting means varying a space between said spaced-apart edges.

3. The device as claimed in claim 2 wherein said adjusting means comprises at least one screw extending through said band and across the space between said edges, whereupon rotation of at least one screw in first and second directions decreases or increases the space between said edges.

4. The device as claimed in claim 3 further comprising at least a second screw adjacent said at least one screw, whereupon rotation of said second screw at least decreases the space between said edges.

5. The device as claimed in claim 1 further comprising a releasable cap at a top of said handle for covering said bore, said cap overlying a canister embedded in said bore.

6. The device as claimed in claim 5 wherein said engaging and securing means further comprises at least one screw extending through said handle and into said bore, said screw having a free end engaging an embedded canister in said bore.

7. The device as claimed in claim 1 wherein said engaging and securing means further comprises at least one screw extending through said handle and into said bore, said screw having a free end engaging an embedded canister in said bore.

8. The device as claimed in claim 1 wherein said discharge means comprises a port in said handle for alignment with a nozzle of a canister embedded in said handle.

9. The device as claimed in claim 1 further comprising a seat for a user's thumb in said handle, said seat generally adjacent a top of an embedded canister.

10. The device as claimed in claim 1 wherein a club is presented by a flashlight.

11. A device for facilitating the use of a chemical canister with a club comprising:

a handle for grasping by a user;

means for releasably attaching said handle to a club;

a bore in said handle configured to present means for releasably receiving and embedding a chemical canister in said handle; and means on said handle for discharge of a chemical from an embedded canister through said handle, whereupon to simultaneously transport and/or use an associated club and canister.

12. The device as claimed in claim 11 further comprising a releasable cap at a top of said handle for covering said bore, said cap overlying a canister embedded in said bore.

13. The device as claimed in claim 12 further comprising at least one screw extending through said handle and into said bore, said screw having a free end bearing against an embedded canister in said bore.

14. The device as claimed in claim 11 further comprising at least one screw extending through said handle and into said bore, said screw having a free end bearing against an embedded canister in said bore.

15. The device as claimed in claim 11 wherein said discharge means comprises a port in said handle for alignment with a nozzle of a canister embedded in said handle.

16. The device as claimed in claim 11 wherein said handle further comprises a seat for a user's thumb in said handle, said seat generally adjacent a top of a canister embedded in said handle.

17. A device for facilitating the use of a club with a chemical canister comprising:

collar means for encircling a club;

means for adjusting the circumference of said collar means whereby to contiguously encircle a club;

handle means extending from said collar means for grasping by a user comprising:

a grip extending from said collar means;

a bore extending through said grip, said bore configured for releasably embedding a chemical canister therein;

a releasable cap at a top of said grip for covering said bore, said cap overlying a canister embedded in said bore;

means for discharge of a chemical from an embedded canister and from said grip, whereupon to simultaneously transport and/or use an associated club and canister.

18. The device as claimed in claim 17 further comprising:

at least one screw extending through said grip and into said bore, said screw having a free end bearing against an embedded canister in said bore.

19. A device for facilitating the use of a club with a chemical canister comprising:

collar means for encircling a club;

means for adjusting the circumference of said collar means whereby to contiguously encircle a club;

handle means extending from said collar means for grasping by a user comprising:

a grip extending from said collar means;

a bore extending through said grip, said bore configured for releasably embedding a chemical canister therein;

at least one screw extending through said grip and into said bore, said screw having a free end bearing against an embedded canister for retaining the same in said bore;

means for discharge of a chemical from an embedded canister and from said grip, whereupon to simultaneously transport and/or use an associated club and canister.

20. A device for facilitating the use of a chemical canister with a club comprising:

a grip for grasping by a user;

means for releasably attaching said grip to a club;

a bore in said grip for releasably embedding a chemical canister therein;

a releasable cap at a top of said grip for covering said bore; and means for discharge of a chemical from an embedded canister and said grip, whereupon to simultaneously transport and/or use an associated club and canister.

21. The device as claimed in claim 20 further comprising at least one screw extending through said grip and into said bore, said screw having a free end bearing against an embedded canister for retaining the same in said bore.

22. A device for facilitating the use of a chemical canister with a club comprising:

a grip for grasping by a user;

means for releasably attaching said grip to a club;

a bore in said grip for releasably embedding a chemical canister therein;

at least one screw extending through said grip and into said bore, said screw having a free end bearing against an embedded canister for retaining the same in said bore; and means for discharge of the chemical from an embedded canister and said grip, whereupon to simultaneously transport and/or use an associated club and canister.

* * * * *